US007144308B2

(12) United States Patent
Cho

(10) Patent No.: US 7,144,308 B2
(45) Date of Patent: Dec. 5, 2006

(54) APPARATUS FOR CHEMICAL MECHANICAL POLISHING

(75) Inventor: Gyung-Su Cho, Bucheon (KR)

(73) Assignee: Dongbu Electronics Co., Ltd., Seoul (KR)

( * ) Notice: Subject to any disclaimer, the term of this patent is extended or adjusted under 35 U.S.C. 154(b) by 0 days.

(21) Appl. No.: 11/220,253

(22) Filed: Sep. 6, 2005

(65) Prior Publication Data

US 2006/0057947 A1 Mar. 16, 2006

(30) Foreign Application Priority Data

Sep. 13, 2004 (KR) ..... 10-2004-0072974

(51) Int. Cl.
*B24B 1/00* (2006.01)

(52) U.S. Cl. ..... 451/285; 451/388; 451/397

(58) Field of Classification Search ..... 451/285, 451/286, 287, 288, 289, 388, 397, 398
See application file for complete search history.

(56) References Cited

U.S. PATENT DOCUMENTS 6,837,774 B1 * 1/2005 Hu et al. ..... 451/8
6,872,258 B1 * 3/2005 Park et al. ..... 118/715
2005/0136806 A1 * 6/2005 Boo et al. ..... 451/41

* cited by examiner

*Primary Examiner*—Jacob K. Ackun, Jr.
(74) *Attorney, Agent, or Firm*—Andrew D. Fortney

(57) ABSTRACT

Apparatus for chemical mechanical polishing are disclosed. A disclosed apparatus includes a polishing station having a polishing pad, a gas supplier to generate pressurized gas to press a wafer toward the polishing pad, and a polishing head assembly including a planar member having a plurality of fine holes in communication with the gas supplier and a membrane to press the wafer toward the polishing pad due to the pressurized gas received through the plurality of fine holes, wherein the plurality of fine holes are arranged to rotate at different radii of rotation when the planar member rotates.

20 Claims, 7 Drawing Sheets

(Prior Art)

(Prior Art)

APPARATUS FOR CHEMICAL MECHANICAL POLISHING

FIELD OF THE DISCLOSURE

The present disclosure relates generally to semiconductor fabrication and, more particularly, to apparatus for chemical mechanical polishing (CMP) using a membrane and which prevent formation of a non-uniformly polished portion during a polishing process.

BACKGROUND

Recently, as the integration of semiconductor devices has increased, the structure of semiconductor devices has become multi-layered. Accordingly, a polishing process for planarizing one or more layers of a semiconductor wafer is typically part of the process of fabricating semiconductor devices. The chemical mechanical polishing (CMP) process has been widely adopted as such a polishing process.

The CMP process is a process for polishing a surface of a wafer coated with, for example, tungsten, oxide, etc. The CMP process employs mechanical friction as well as a chemical abrasive to polish a surface. Mechanical polishing polishes a surface of a wafer using friction between a polishing pad and the surface of the wafer by rotating the wafer while the wafer is fixed on a rotating polishing head and while the wafer is pressed against a polishing pad. Chemical polishing polishes the surface of the wafer using slurry supplied between the polishing pad and the wafer as a chemical abrasive.

The CMP polishing process may achieve high planarity not only within a narrow region, but also over a wide region. Therefore, the CMP process is considered most appropriate as wafers become wider.

A typical CMP apparatus for performing a CMP process is shown in FIG. 1. The apparatus of FIG. 1 includes a polishing station 110 and a polishing head 120. The polishing station 110 includes a turn-table 114 provided with a polishing pad 112. The polishing head 120 includes, as shown in FIG. 2, a planar member 122, a protective guard 124, and a membrane 126.

A plurality of fine holes 122' (e.g., twenty-eight fine holes 122') are formed in the planar member 122, in, for example, the manner shown in FIG. 3, (i.e., in concentric circles about a central, vertical axis of the planar member 122). The fine holes 122' are connected through fluid lines 150 to a vacuum generator 130. The vacuum generator generates a vacuum pressure for loading a wafer W'. The fine holes 122' are also connected to a gas supplier 140 which supplies pressurized gas (e.g., Nitrogen gas) while polishing the wafer W'.

In FIG. 1, the reference numeral 152 denotes an arm connected to the polishing head, and the reference numeral 154 denotes a slurry supplier.

In the chemical mechanical polishing apparatus of FIG. 1, the wafer W' is loaded by the vacuum pressure generated by the vacuum generator 130. The wafer W' is polished while the wafer W' is pressed against the polishing pad 112 due to a bulging of the membrane 126 caused by the gas pressure supplied from the gas supplier 140.

However, when a wafer W' polished with such a chemical mechanical polishing apparatus is examined, the wafer W' typically exhibits non-uniformly polished portions D in a circular stripe pattern as shown in FIG. 4. These non-uniformly polished portions D will hereinafter be called circular stripe portions.

When the polishing uniformity is deteriorated by such circular stripe portions D, a semiconductor device fabricated with the polished wafer may operate abnormally.

As a simple solution for such non-uniform polishing, a wafer may be polished while not pressing it to the polishing pad. However, the polishing speed is reduced when such a solution is employed. Accordingly, the productivity of the wafer manufacturing process is likewise reduced.

DETAILED DESCRIPTION

The circular stripe portions D discussed above have been investigated by the inventor named in this Patent and have been found to be formed due to excessive polishing of some portions of the wafer relative to other portions of the wafer. These differences in polishing amounts have been found to occur for the following reasons.

Figure 3:
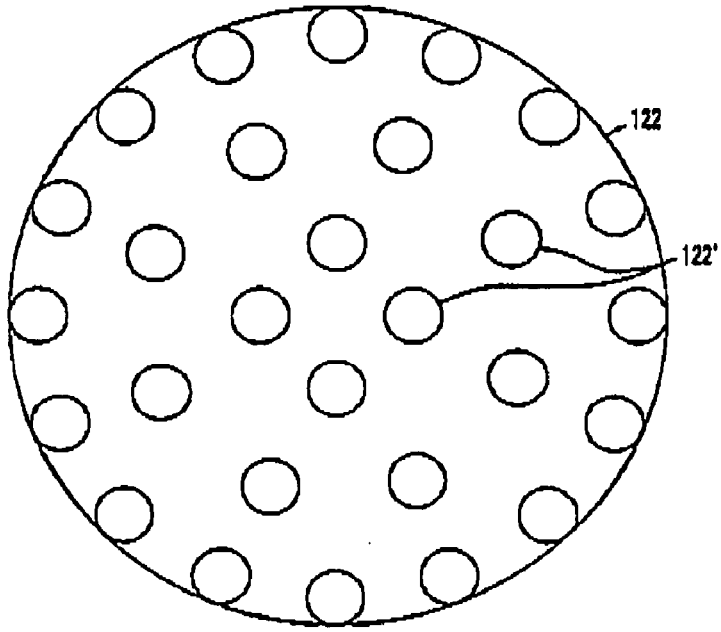
FIG. 3 is a top plan view of a conventional planar member which may be employed in the CMP apparatus of FIG. 1.

When a wafer W' is pressed by the planar member 122 of FIG. 3 due to the bulging of the membrane 126, the air pressure active on the wafer W' is slightly greater at the concentric circular areas including the fine holes 122' than at other areas of the planar member 122 (refer to FIG. 3). Therefore, the circular stripe portions D are formed along the concentric circular areas of the fine holes 122'.

Figure 1:
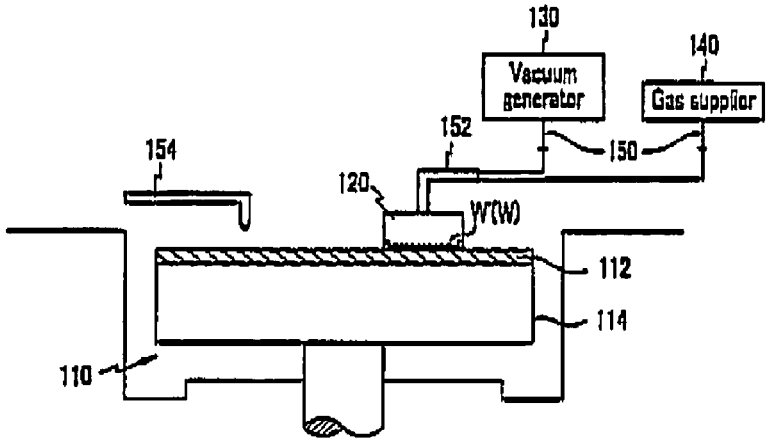
FIG. 1 is a schematic diagram of an example apparatus for chemical mechanical polishing.
Figure 2:
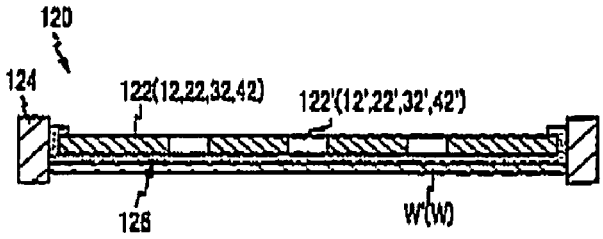
FIG. 2 is a schematic diagram of a prior art polishing head which may be employed in the CMP apparatus of FIG. 1.

As discussed above, an example apparatus for chemical mechanical polishing is shown in FIG. 1. The example apparatus of FIG. 1 includes a polishing station 110 and a polishing head 120. The polishing station 110 includes a turn-table 114 carrying a polishing pad 112. The polishing head 120 includes a protective guard 124 and a membrane 126. As discussed, above, the polishing head has traditionally been provided with a planar member 122 such as the planar member 122 shown in FIG. 3. However, this patent discloses several different example planar members 12, 22, 32, and/or 42, that may be employed in place of the planar member 122 of FIG. 3 to achieve improved polishing results.

Figure 5:
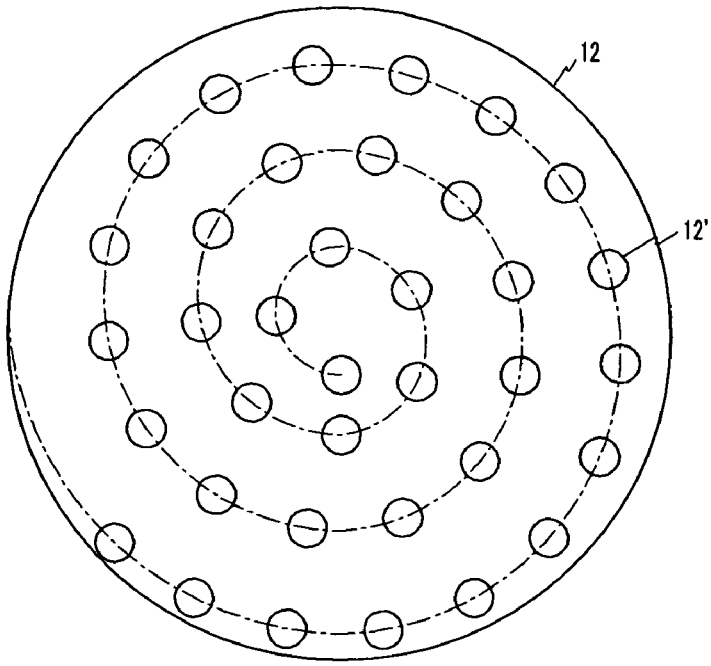
FIG. 5 is a top plan view of a first example planar member constructed in accordance with the teachings of the present invention.

FIG. 5 is a top plan view of a first example planar member 12 constructed in accordance with the teachings of the present invention for use with a chemical mechanical polishing apparatus such as the apparatus shown in FIG. 1. The example planar member 12 of FIG. 5 includes a plurality of fine holes. In the example shown in FIG. 5, the plurality of fine holes 12' formed in the planar member 12 are arranged along a spiral line pattern (refer to the one-point chain line in FIG. 5).

Figure 4:
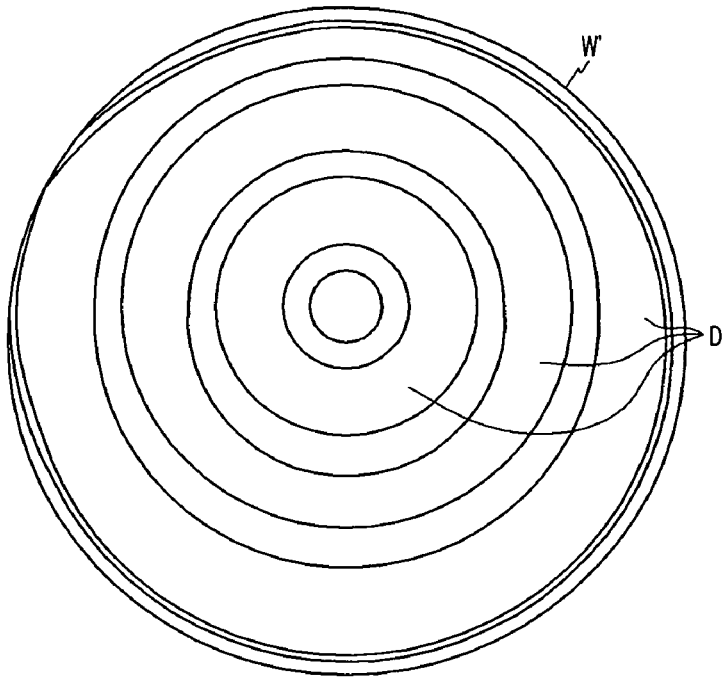
FIG. 4 is a top plan view of a wafer formed with circular stripe portions as a result of being polished with a conventional planar member.

Each of the fine holes 12' in the spiral line pattern rotates at a different radial difference from the center of the planar member 12 when the planar member 12 rotates. As a result, even if the wafer W receives slightly higher pressure at portions associated with the fine holes 12' than at other portions due to the supply of the gas pressure from the gas supplier 140, the effect on the polishing due to this pressure difference is preferably reduced or neutralized since each fine hole 12' has a different radius of rotation. Therefore, the polishing effect achieved using the planar member 12 is preferably more uniform than the polishing effect shown in FIG. 4. In particular, the wafer W is preferably uniformly polished over its entire surface. Because this uniformity may be achieved without reducing the pressure applied to the planar member, the polishing speed is preferably not reduced and may be increased, thereby enhancing the productivity of the semiconductor fabrication process employing this polishing technique.

Figure 6A:
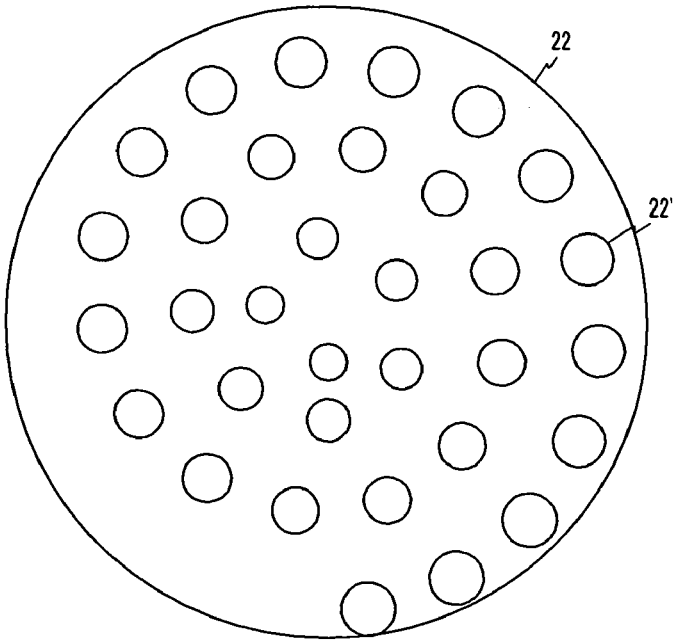
FIG. 6A and FIG. 6B are top plan views of second and third example planar members constructed in accordance with the teachings of the present invention.
Figure 6B:
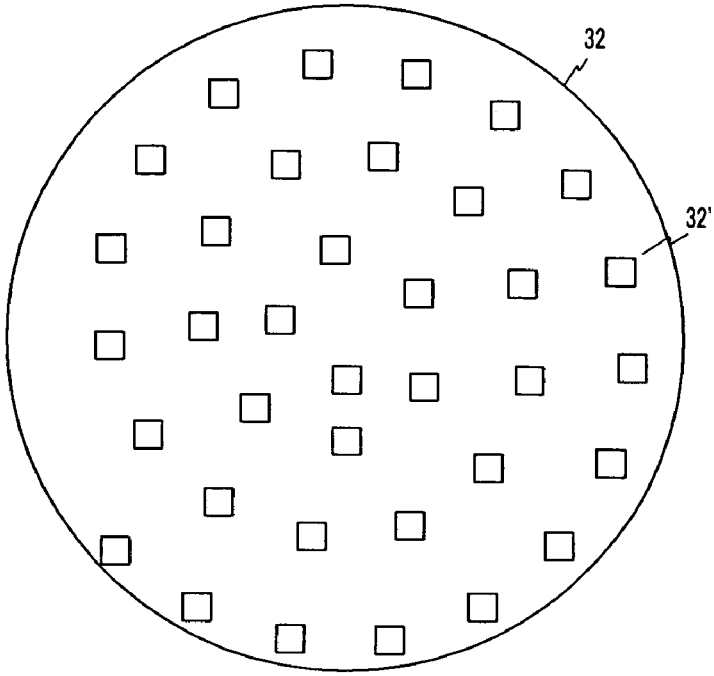

FIG. 6A and FIG. 6B respectively show top plan views of second and third example planar members 22 and 32 constructed in accordance with the teachings of the present invention. The second and third example planar members 22, 32 are variations of the example planar member 12 of FIG. 5.

As shown in FIG. 6A, the second example planar member 22 is formed with fine holes 22' having different diameters. In the example of FIG. 6A, the diameters of the fine holes 22' increase as they get closer to an exterior circumference of the planar member 22. However, it will be appreciated by persons of ordinary skill in the art that the diameters may change in a different manner (e.g., in a manner opposite to that shown such that the hole of the largest diameter is located near the center of the planar member 22).

Additionally or alternatively, although not shown in the figures, the diameters of the fine holes 22' may be formed to increase or decrease stepwise as they get closer to the exterior circumference of the planar member 22. For example, a fine hole in a central region of the planar member 22 may have a first diameter, and a fine hole in a region exterior to the central region may have a second diameter larger than the first diameter.

A third example planar member 32 which may be used with a CMP apparatus such as the apparatus of FIG. 1 is shown in FIG. 6B. The example planar member 32 of FIG. 6B includes fine holes 32' having a polygonal shape. In the example of FIG. 6B, each of the fine holes 32' has a rectangular shape. However, it should be understood that the fine holes 32' may be formed in any other shape.

Figure 7:
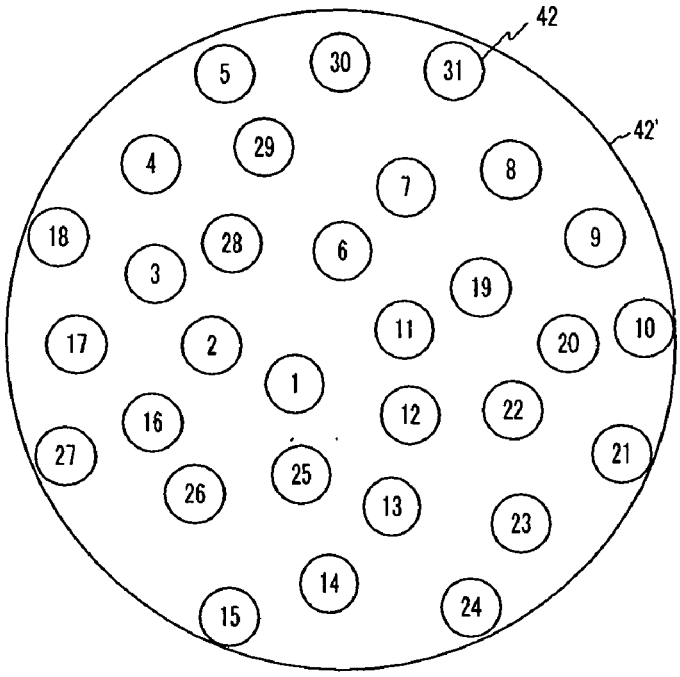
FIG. 7 is a top plan view of a fourth example planar member constructed in accordance with the teachings of the present invention.

FIG. 7 is a top plan view of a fourth example planar member 42 constructed in accordance with the teachings of the present invention. As shown in FIG. 7, the example planar member 42 includes a plurality of fine holes 42' that are arranged in a vane shaped pattern. In the illustrated example, the fine holes 42' are located at different distances from the center of the planar member 42. Therefore, the holes have respectively different radii of rotation.

For better comprehension, serial numbers from 1 to 31 are shown in the fine holes 42' in FIG. 7. In the example of FIG. 7, an array of fine holes 1–5, an array of fine holes 6–10, an array of fine holes 11–15, an array of fine holes 16–18, an array of fine holes 19–21, an array of fine holes 22–24, and an array of fine holes 25–27 form an overall pattern of a vane shape.

As in the other examples described above, non-uniform polishing in a circular stripe pattern may be prevented by an arrangement of the fine holes 42' in such a vane shaped pattern.

In the above description, the example planar members 22 and 32 shown in FIGS. 6A and 6B are variations of the planar member 12 shown in FIG. 5. Although not shown in the drawings, a further example planar member may be obtained by altering the example planar member 42 shown in FIG. 7 using a similar variation technique or its equivalent as applied to the first example to achieve the second and third example members or their equivalents. In other words, the fine holes arranged in the vane shaped pattern on the planar member 42 may be altered to have various shapes. For example, the diameters of the fine holes may increase gradually or stepwise as they get closer to an exterior circumference of the planar member. Additionally or alternatively, the fine holes may be formed in a polygonal shape (e.g., a rectangle).

Although in the above-described examples, the fine holes are described as being formed in a spiral line pattern or a vane shaped pattern, persons of ordinary skill in the art will appreciate that the fine holes may alternatively be formed in an irregular pattern. Additionally or alternatively, at least some of the respective distances between the fine holes may be formed to be different with respect to each other.

In the above described examples, fine holes to supply pressurized gas to a membrane are formed, for example, in a spiral line pattern or a vane shaped pattern, so as to rotate at different radii. As a result, a surface of a wafer may be more uniformly polished as the pressurized gas is supplied through the fine holes.

Consequently, deterioration of the yield of semiconductor devices due to non-uniform planarization may be prevented, and polishing speed of a wafer may be enhanced.

From the foregoing, persons of ordinary skill in the art will appreciate that apparatus for chemical mechanical polishing have been provided which prevent the occurrence of non-uniformly polished portions forming a circular stripe pattern.

An example apparatus for chemical mechanical polishing includes a polishing station provided with a polishing pad, a gas supplier generating pressurized gas for pressing a wafer against the polishing pad, and a polishing head assembly including a planar member having a plurality of fine holes connected to the gas supplier through a fluid line and a membrane pressing the wafer against the polishing pad by the pressurized gas received through the plurality of fine holes, wherein the plurality of fine holes are arranged such that they rotate at different radii of rotation when the planar member rotates.

In some examples, the plurality of fine holes are arranged in a vane-shaped pattern or a spiral line pattern proceeding from a center of the planar member.

In some examples, the plurality of fine holes are arranged in an irregular pattern.

In some examples, the fine holes in the plurality have a circular shape or a polygonal shape.

In some examples, the fine holes in the plurality have a plurality of different sizes.

In some examples, the fine holes in the plurality have a plurality of different shapes and a plurality of different sizes.

In some examples, the fine holes are equally spaced from one another. In other examples, the fine holes are not equally spaced.

In some examples, the diameters of the fine holes increase as they get closer to an exterior circumference of the planar member.

It is noted that this patent claims priority from Korean Patent Application Serial Number 10-2004-0072974, which was filed on Sep. 13, 2004, and is hereby incorporated by reference in its entirety.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An apparatus for chemical mechanical polishing, comprising:

a polishing station provided with a polishing pad;

a gas supplier to generate pressurized gas for pressing a wafer against the polishing pad; and a polishing head assembly including a planar member having a plurality of holes connected to the gas supplier through a fluid line and a membrane to press the wafer against the polishing pad under the influence of the pressurized gas received through the plurality of holes, wherein the plurality of holes are arranged such that they rotate at different radii of rotation when the planar member rotates.

2. An apparatus as defined in claim 1, wherein the plurality of holes are arranged in a vane-shaped pattern.

3. An apparatus as defined in claim 1 wherein the plurality of holes are arranged in a spiral line pattern.

4. An apparatus as defined in claim 1, wherein the plurality of holes are arranged in an irregular pattern.

5. An apparatus as defined in claim 1, wherein at least some of the holes have a circular shape.

6. An apparatus as defined in claim 1, wherein at least some of the holes have a polygonal shape.

7. An apparatus as defined in claim 2, wherein at least some of the holes have a circular shape.

8. An apparatus as defined in claim 2, wherein at least some of the holes have a polygonal shape.

9. An apparatus as defined in claim 4, wherein at least some of the holes have a circular shape.

10. An apparatus as defined in claim 4, wherein at least some of the holes have a polygonal shape.

11. An apparatus as defined in claim 1, wherein the holes have a plurality of sizes.

12. An apparatus as defined in claim 2, wherein the holes have a plurality of sizes.

13. An apparatus as defined in claim 4, wherein the holes have a plurality of sizes.

14. An apparatus as defined in claim 1, wherein diameters of the holes increase from a center of the planar member to an exterior circumference of the planar member.

15. An apparatus as defined in claim 2, wherein diameters of the holes increase from a center of the planar member to an exterior circumference of the planar member.

16. An apparatus as defined in claim 1, wherein:

the plurality of holes are arranged in a (1) vane-shaped pattern or (2) a spiral line pattern proceeding outward from a center of the planar member;

the holes have a circular shape or a polygonal shape; and the diameters of the holes near an exterior circumference of the planar member are larger than the diameters of the holes near the center of the planar member.

17. A polishing head for holding a wafer to be polished in a chemical mechanical polishing apparatus, the polishing head having a planar member comprising:

a body defining a plurality of holes, the plurality of holes being located such that they do not form concentric circles about a central axis of the body.

18. An apparatus as defined in claim 17, wherein the plurality of holes are located to rotate at different radii of rotation when the planar member rotates.

19. A polishing head as defined in claim 17, wherein the plurality of holes are arranged in a (1) vane-shaped pattern or (2) a spiral line pattern; and the holes have a circular shape or a polygonal shape.

20. A polishing head as defined in claim 17, wherein the diameters of the holes near an exterior circumference of the body are larger than the diameters of the holes near a center of the body.

* * * * *